US008340846B2

(12) United States Patent
Mizutani et al.

(10) Patent No.: US 8,340,846 B2
(45) **Date of Patent: *Dec. 25, 2012**

(54) BOAT PROPELLING SYSTEM

(75) Inventors: Makoto Mizutani, Shizuoka (JP); Ryuta Hayami, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 291 days.

This patent is subject to a terminal disclaimer.

(21) Appl. No.: 12/777,299

(22) Filed: May 11, 2010

(65) Prior Publication Data

US 2010/0292876 A1 Nov. 18, 2010

(30) Foreign Application Priority Data

May 12, 2009 (JP) ..... 2009-115753

(51) Int. Cl.

| | |
|---|---|
| ***B60G 17/018*** | (2006.01) |
| ***B60G 23/00*** | (2006.01) |
| ***B62C 3/00*** | (2006.01) |
| ***B62K 25/00*** | (2006.01) |
| ***G06F 7/00*** | (2006.01) |
| ***G06F 17/00*** | (2006.01) |
| ***A01B 69/00*** | (2006.01) |
| ***B62D 11/00*** | (2006.01) |
| ***B60W 10/04*** | (2006.01) |
| ***B63H 21/22*** | (2006.01) |
| ***B63H 25/02*** | (2006.01) |
| ***G05D 1/02*** | (2006.01) |

(52) U.S. Cl. ..... 701/21; 701/41; 701/42; 701/43; 440/84; 440/86; 440/53; 440/58; 440/59; 114/144 R; 114/144 RE; 114/144 A; 114/145 R

(58) Field of Classification Search ..... 701/20, 701/21, 43, 44; 440/84, 86, 53, 58, 59; 114/144 R, 114/145 R, 144 RE, 144 A
See application file for complete search history.

(56) References Cited

U.S. PATENT DOCUMENTS 5,169,348 A * 12/1992 Ogiwara et al. ..... 440/1

(Continued)

FOREIGN PATENT DOCUMENTS

JP 2000-344191 A 12/2000

(Continued)

OTHER PUBLICATIONS

Mizutani et al., "Boat Propelling System", U.S. Appl. No. 12/753,253, filed Apr. 2, 2010.

(Continued)

*Primary Examiner* — James Trammell
*Assistant Examiner* — Daniel L Greene
(74) *Attorney, Agent, or Firm* — Keating & Bennett, LLP

(57) ABSTRACT

A boat propelling system capable of determining operation accuracy of a transmission mechanism includes an outboard engine main body, a swivel bracket arranged to allow the outboard engine main body to pivot in a right-left direction with respect to a hull, an electric motor provided in the swivel bracket to pivot the outboard engine main body in the right-left direction, a pivot sensor provided in the electric motor to detect a pivot angle of a motor shaft, a transmission mechanism provided in the swivel bracket to transmit a driving force of the electric motor to the outboard engine main body, a pivot sensor arranged to detect an actual pivot angle of the outboard engine main body, and an Electronic Control Unit arranged and programmed to control an operation of the boat propelling system.

8 Claims, 9 Drawing Sheets

U.S. PATENT DOCUMENTS

| | | | | |
|---|---|---|---|---|
| 5,884,213 | A * | 3/1999 | Carlson | 701/21 |
| 6,431,928 | B1 * | 8/2002 | Aarnivuo | 440/58 |
| 6,843,195 | B2 * | 1/2005 | Watabe et al. | 114/144 E |
| 7,506,599 | B2 * | 3/2009 | Mizutani | 114/144 R |
| 7,533,624 | B2 * | 5/2009 | Mizutani | 114/144 R |
| 7,540,253 | B2 * | 6/2009 | Mizutani | 114/144 RE |
| 2004/0162649 | A1 | 8/2004 | Takada et al. | |
| 2005/0170712 | A1 * | 8/2005 | Okuyama | 440/59 |
| 2006/0110990 | A1 | 5/2006 | Yazaki et al. | |
| 2006/0166567 | A1 | 7/2006 | Otobe et al. | |
| 2011/0143608 | A1 * | 6/2011 | Chiecchi | 440/53 |

FOREIGN PATENT DOCUMENTS

| | | | |
|---|---|---|---|
| JP | 2004-249792 | A | 9/2004 |
| JP | 2006-150998 | A | 6/2006 |
| JP | 2006-199189 | A | 8/2006 |

OTHER PUBLICATIONS

Mizutani et al., "Boat Propelling System", U.S. Appl. No. 12/832,178, filed Jul. 8, 2010.

* cited by examiner

BOAT PROPELLING SYSTEM

BACKGROUND OF THE INVENTION

1. Field of the Invention

The present invention relates to boat propelling systems, and more specifically, to a boat propelling system including an electric motor arranged to pivot a propelling system main body in a right-left direction with respect to the hull.

2. Description of the Related Art

As disclosed in JP-A 2006-199189, for example, use of an electric motor to pivot an outboard engine (propelling system main body) in a right-left direction with respect to a hull for steering the hull is a conventional technique.

According to the technique in JP-A 2006-199189, a target pivot angle of a propelling system main body (e.g., outboard engine main body) which pivots with respect to the hull, is set by using a steering wheel turning angle or the like. Then, based on an angle difference between an actual pivot angle and the target pivot angle of the outboard engine, a drive amount of an electric motor is determined and the electric motor is driven. The driving power of the electric motor is transmitted via a reduction gear mechanism to a shaft section, and as the shaft section rotates, the outboard engine is pivoted in a right-left direction with respect to the hull.

However, the reduction gear mechanism will lose operation accuracy due to deterioration from wear or the like. Then, even if the electric motor is driven by the drive amount which is based on the angle difference between the actual pivot angle and the target pivot angle, the actual pivot angle after the electric motor is driven is different from the target pivot angle. JP-A 2006-199189 makes no consideration of or compensation for a potential decrease in operation accuracy caused by deterioration or the like of the reduction gear mechanism which serves as a transmission mechanism, and therefore makes no disclosure or indication regarding determination of operation accuracy of the reduction gear mechanism.

SUMMARY OF THE INVENTION

Preferred embodiments of the present invention provide a boat propelling system that is capable of determining operation accuracy of a transmission mechanism.

According to a preferred embodiment of the present invention, a boat propelling system for propelling a hull includes a propelling system main body; a bracket section arranged to allow the propelling system main body to pivot in a right-left direction with respect to the hull; an electric motor provided in the bracket section to pivot the propelling system main body in the right-left direction; a transmission mechanism provided in the bracket section to transmit a driving force of the electric motor to the propelling system main body; an actual pivot angle detection section arranged to detect an actual pivot angle of the propelling system main body; a first information obtaining section arranged to obtain first information regarding an actual pivot angle change amount of the propelling system main body based on a detection result of the actual pivot angle detection section; a second information obtaining section arranged to obtain second information regarding a calculated theoretical pivot angle change amount of the propelling system main body based on a drive amount of the electric motor; and a determination section arranged to determine an operation accuracy of the transmission mechanism based on a result of a comparison between the first information and the second information.

In a preferred embodiment of the present invention, the first information regarding an actual pivot angle change amount of the propelling system main body is obtained based on a result of detection made by the actual pivot angle detection section while the second information regarding a calculated theoretical pivot angle change amount of the propelling system main body is obtained based on a drive amount of the electric motor. Under a normal state, the electric motor drive amount and the actual pivot angle change amount are in a proportional relationship in accordance with a predetermined transmission ratio of the transmission mechanism. Hence, it is possible to obtain a normal-state, calculated theoretical pivot angle change amount by multiplication between the electric motor drive amount and the predetermined transmission ratio of the transmission mechanism. The calculated theoretical pivot angle change amount described above is indicated by the second information, and if a comparison between the first information and the second information reveals a large gap between the two, it is determined that operation accuracy of the transmission mechanism has decreased due to deterioration from wear or the like. By comparing the first information and the second information as described, the system can easily determine operation accuracy of the transmission mechanism.

Preferably, the boat propelling system further includes a locking member which is provided more on the transmission mechanism side than is the electric motor, to lock the transmission mechanism to prevent the propelling system main body from being pivoted in the right-left direction by a force exerted on the propelling system main body. In this case, the locking member locks the transmission mechanism when the propelling system main body receives an external force. This prevents the propelling system main body from being pivoted in the right-left direction. This eliminates the need for supplying electric power constantly to the electric motor, making it possible to reduce electric power consumption. Since the locking member such as described is provided more on the transmission mechanism side than is the electric motor, decrease in operation accuracy of the locking member, which may be caused by deterioration from wear, etc., will also increase the amount of gap between the first information and the second information. Hence, operation accuracy of the transmission mechanism and locking member can be determined easily by comparing the first information and the second information.

Further preferably, the transmission mechanism includes a buffer member arranged to absorb an impact. In this case, it is possible to reduce deterioration of the transmission mechanism caused by wear, etc., since the buffer member absorbs impacts which act on the transmission mechanism as the propelling system main body receives external forces. Therefore, it is possible to reduce decrease in the operation accuracy of the transmission mechanism. In other words, it is possible to extend the life of the transmission mechanism.

Further, preferably, the boat propelling system includes a control section arranged and programmed to control an output of the propelling system main body based on a result of determination by the determination section. In this case, an output from the propelling system main body is restricted to reduce the boat speed if there is a determination that operation accuracy of the transmission mechanism has decreased. This prevents the hull from deviating excessively from an intended direction of travel even under a situation where the operation accuracy of the transmission mechanism has decreased and there is an increased gap between the target pivot angle and the actual pivot angle. In general, when the propelling system main body has a greater output and the boat speed is higher, the boat has a greater yaw rate. In other words, when the propelling system main body has a greater output and the boat speed is higher, the boat turns well even if the pivot angle is small. Preferred embodiments of the present invention therefore provide an advantage particularly when the propelling system main body has a high output.

The above-described and other features, elements, characteristics, steps, aspects and advantages of the present invention will become clearer from the following detailed description of preferred embodiments of the present invention with reference to the attached drawings.

DETAILED DESCRIPTION OF THE PREFERRED EMBODIMENTS

Hereinafter, preferred embodiments of the present invention will be described with reference to the drawings.

The description will cover a case where a boat propelling system 10 according to a preferred embodiment of the present invention is installed in a boat 1. A symbol "FWD" which appears in some of the drawings indicates a forward traveling direction of the boat 1.

Figure 2:
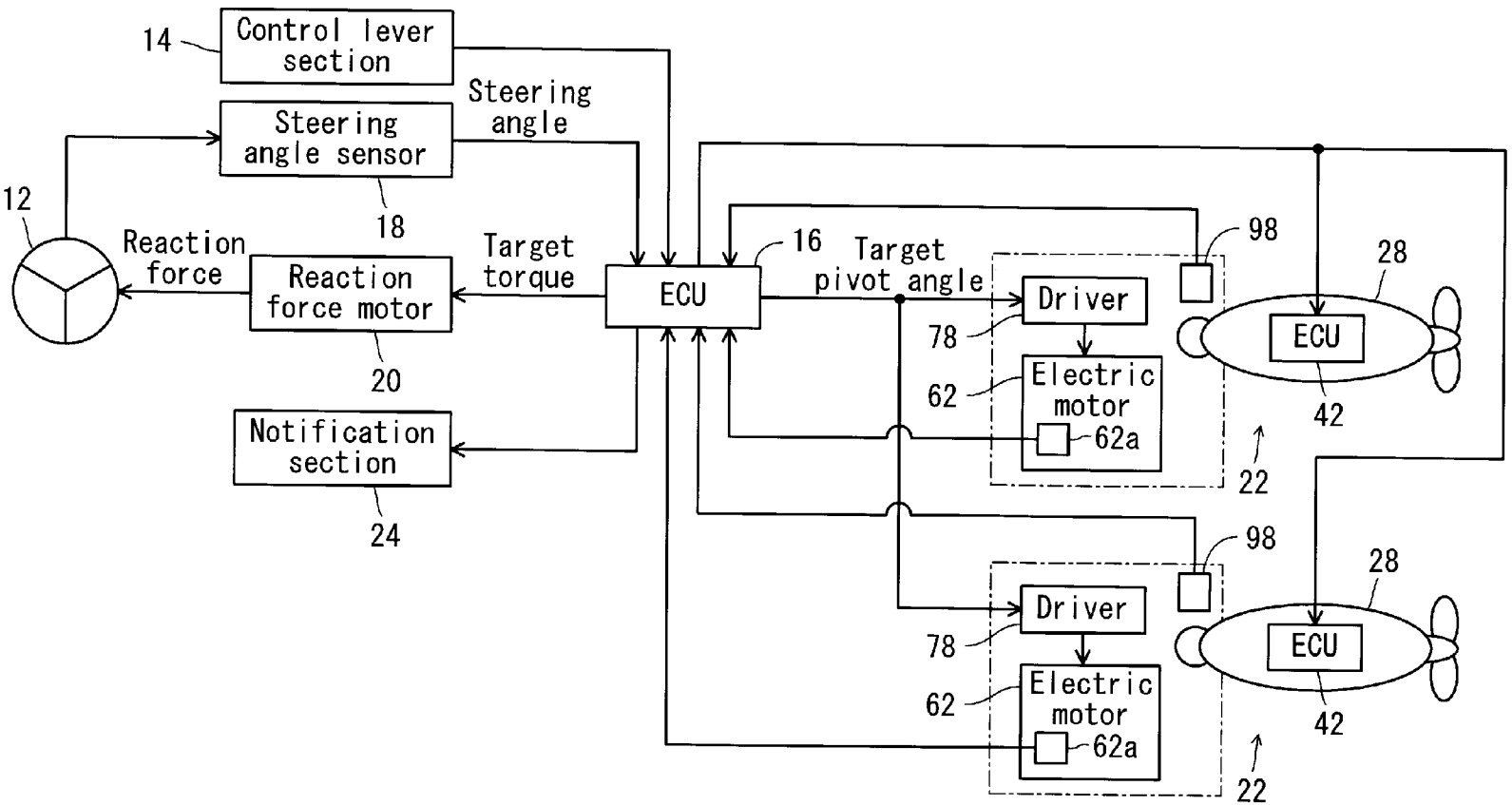
FIG. 2 is a block diagram showing a configuration of the boat propelling system in FIG. 1.

Referring also to FIG. 2, the boat 1 includes a hull 2 and a boat propelling system 10 installed on the hull 2.

The boat propelling system 10 includes a steering section 12 arranged inside the hull 2 to steer outboard engine main bodies 28 (to be described later); a control lever section 14 arranged near the steering section 12 to perform a forward-moving or rearward-moving operation of the hull 2; an ECU (Electronic Control Unit) 16 arranged and programmed to control operations of the boat propelling system 10; a steering angle sensor 18 arranged to detect a steering angle of a rotating operation of the steering section 12; a reaction force motor 20 which is connected to the steering section 12 to provide the steering section 12 with a reaction force; a plurality (e.g., two) of outboard engines 22 mounted on a transom board 3 of the hull 2 in order to propel the boat 1; and a notification section 24 arranged to notify an user of the deterioration of a transmission mechanism 66 (to be described later) and so on. These elements may preferably be electrically interconnected, mainly by a LAN cable 26.

Next, the outboard engines 22 will be described.

The outboard engines 22 do not have rudders but provide steering as the outboard engines 22 are moved like a rudder.

Figure 3:
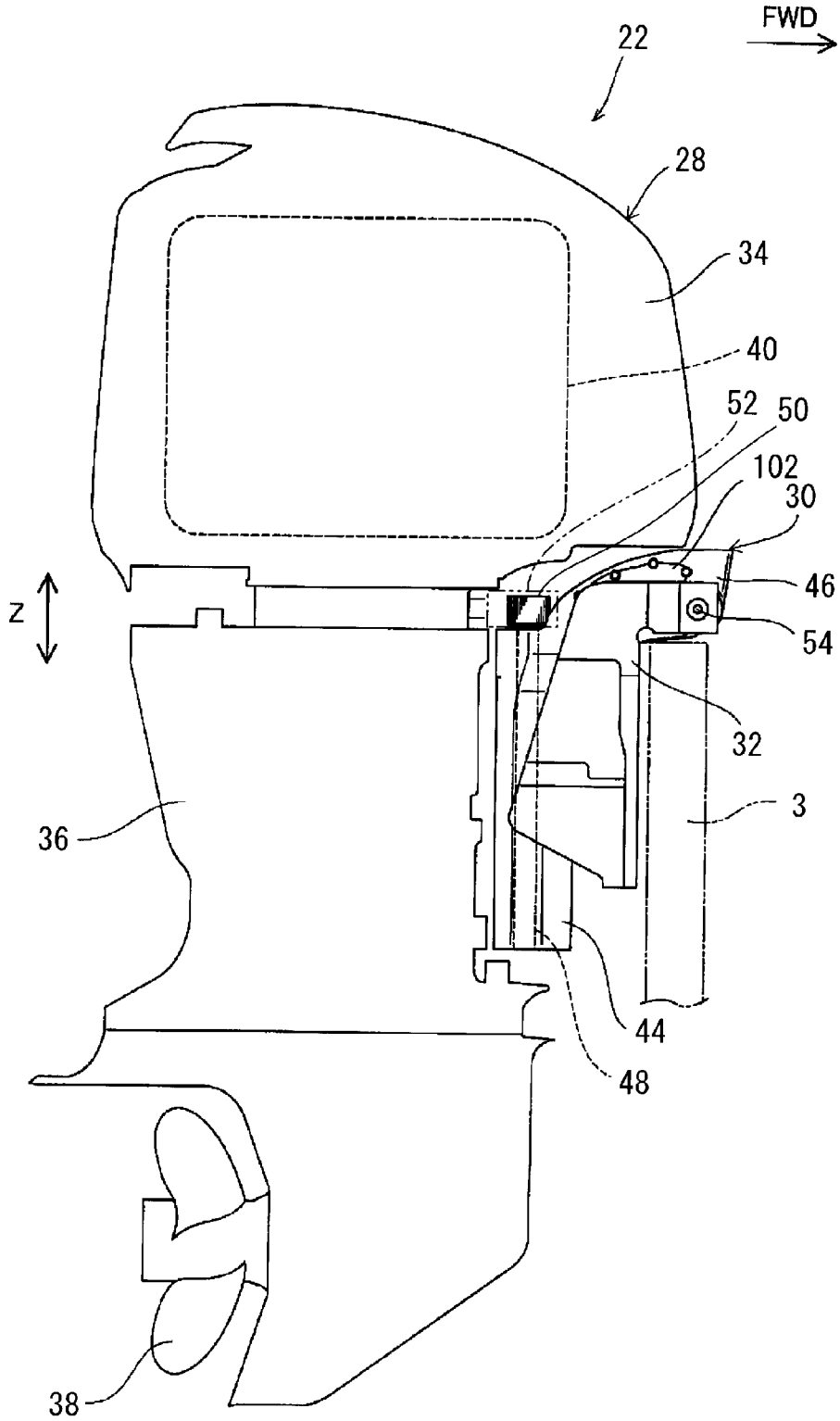
FIG. 3 is a side view showing an overall configuration of an outboard engine in FIG. 1.

Referring to FIG. 3, each outboard engine 22 includes an outboard engine main body 28, a swivel bracket 30 and tilt brackets 32.

The outboard engine main body 28 includes, from top to down, a cowling section 34, a case section 36 and a propeller 38. In the outboard engine 22, the outboard engine main body 28 is pivoted in the right-left direction to change the direction of the propeller 38. The hull 2 changes its direction as it receives propelling force from the propellers 38.

Figure 1:
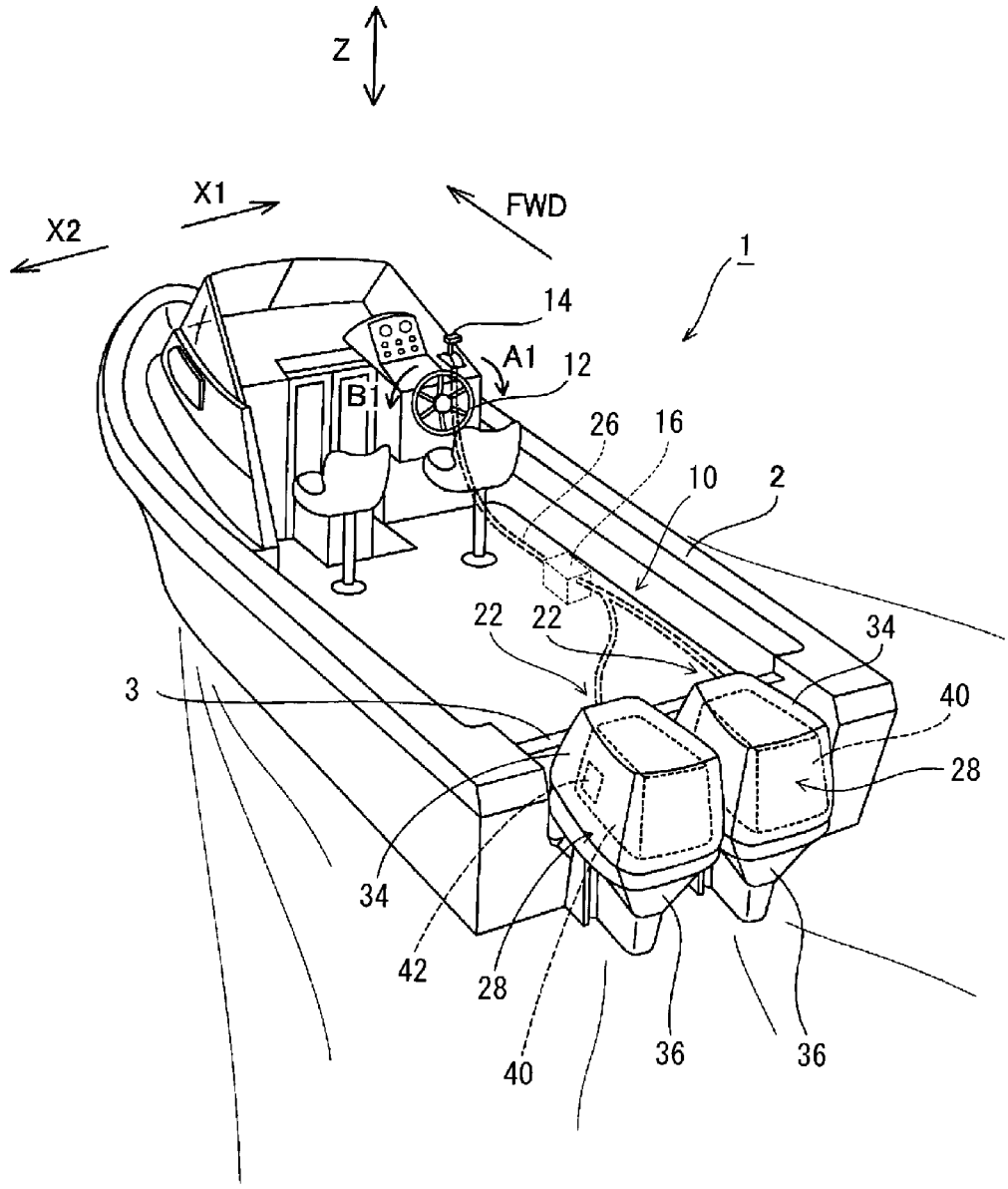
FIG. 1 is a perspective view showing an example of a boat which is equipped with a boat propelling system according to a preferred embodiment of the present invention.

The cowling section 34 houses such components as an engine 40 and the ECU 42 (see FIG. 1) which is electrically connected with the engine 40.

The swivel bracket 30 includes a bracket lower portion 44 and a bracket upper portion 46.

The bracket lower portion 44 is a hollow tube provided in an up-down direction (Direction Z) of the outboard engine main body 28. Into the bracket lower portion 44, a swivel shaft 48 is pivotably inserted, so the swivel shaft 48 is held to extend in the up-down direction (Direction Z) of the outboard engine main body 28. The swivel shaft 48 includes an upper end 50, which is connected with the outboard engine main body 28 via a connection fitting 52. Thus, the outboard engine main body 28 is mounted to the swivel bracket 30 pivotably around the swivel shaft 48, i.e., pivotably in the right-left direction (indicated by Arrow X1 and Arrow X2 in FIG. 1) relative to the hull 2.

The swivel bracket 30 is sandwiched between a pair of tilt brackets 32. The tilt brackets 32 are fixed to the transom board 3 on the rear side of the hull 2. The swivel bracket 30 and the tilt brackets 32 are penetrated by a tilt shaft 54. The tilt shaft 54 extends perpendicularly or substantially perpendicularly to the swivel shaft 48, in a widthwise direction (indicated by Arrow X1 and Arrow X2 in FIG. 1) of the hull 2. Thus, the swivel bracket 30, i.e., the outboard engine main body 28 is pivotable around the tilt shaft 54, in the up-down direction (Direction Z) relatively to the hull 2. In other words, the outboard engine main body 28 is pivotable around the tilt shaft 54 by a tilt cylinder (not illustrated), and is pivoted up to a near horizontal position when the boat comes ashore, for example. The outboard engine main body 28 is also pivotable around the tilt shaft 54 by a trim cylinder (not illustrated). Thus, the trim angle of the outboard engine main body 28 is adjustable, so that an up-down propelling direction of the propellers 38 is adjusted within a given vertical plane, during navigation.

Figure 4:
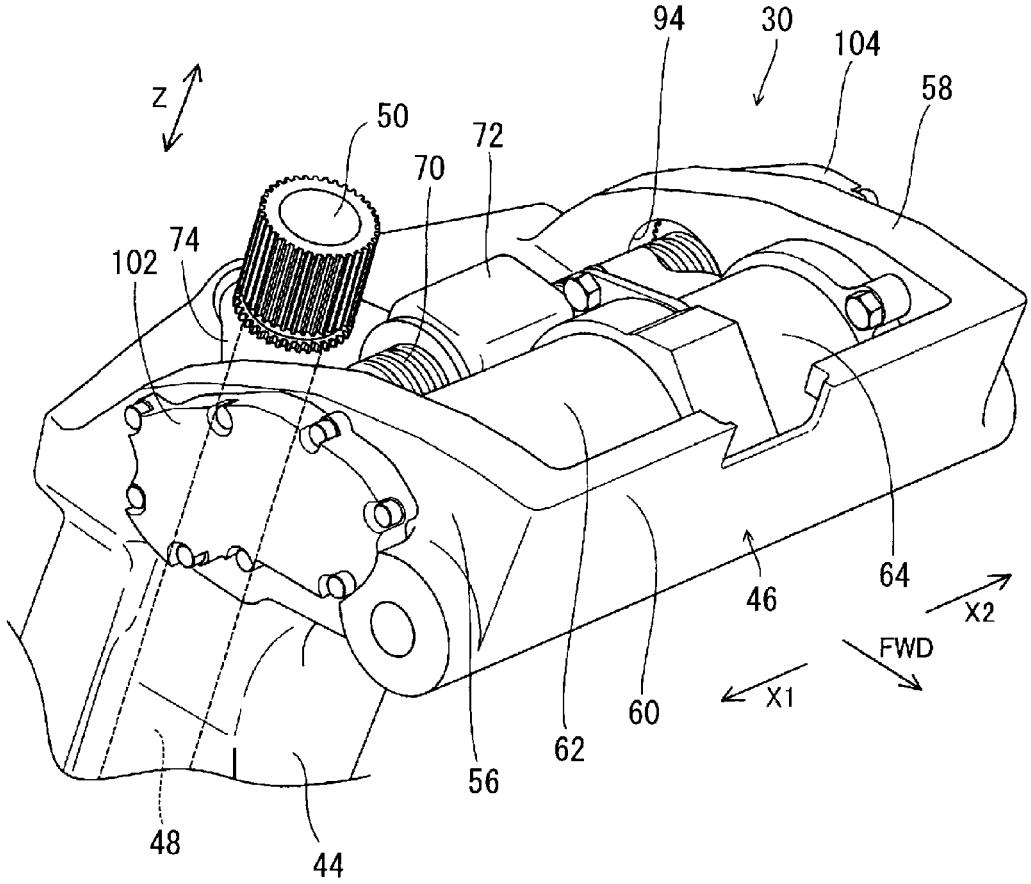
FIG. 4 is a perspective view for describing a configuration of a swivel bracket of the outboard engine in FIG. 1.
Figure 5:
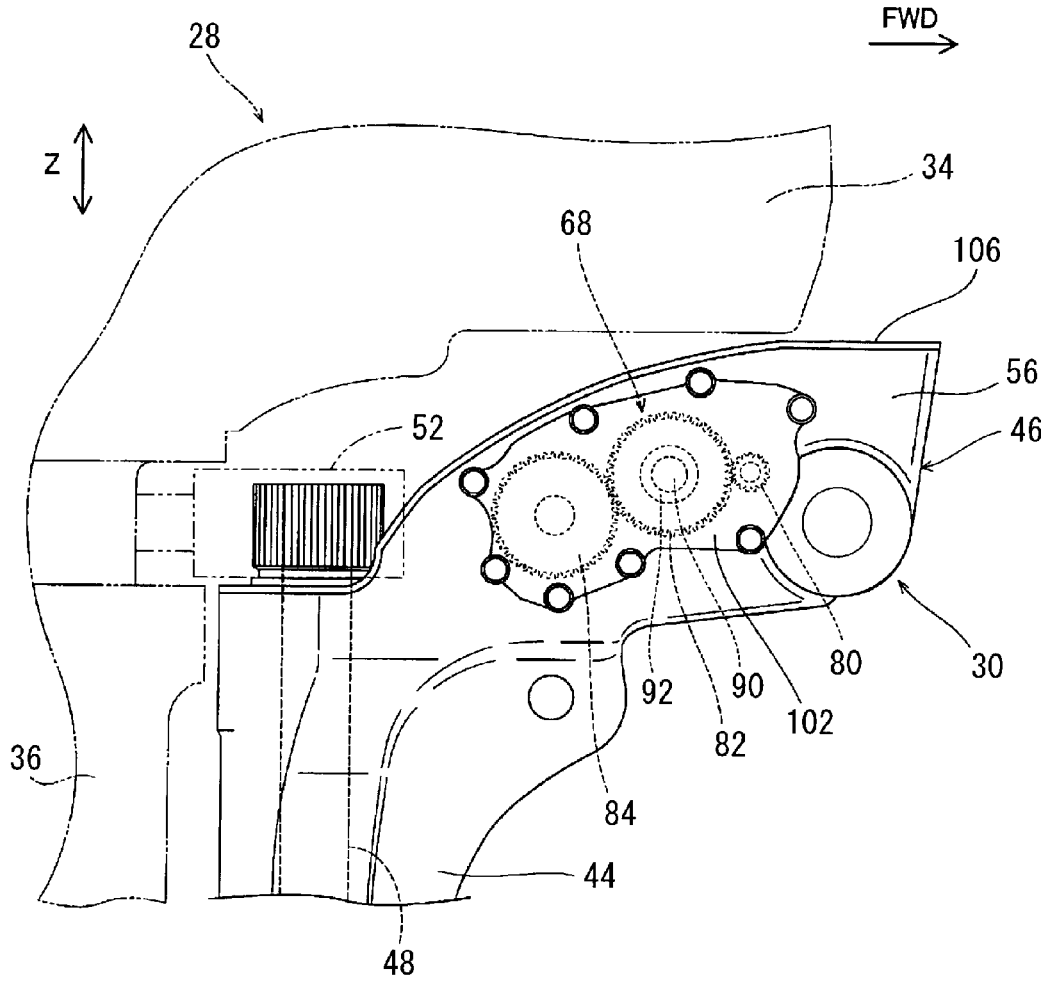
FIG. 5 is a side view for describing the configuration of the swivel bracket of the outboard engine in FIG. 1.
Figure 6:
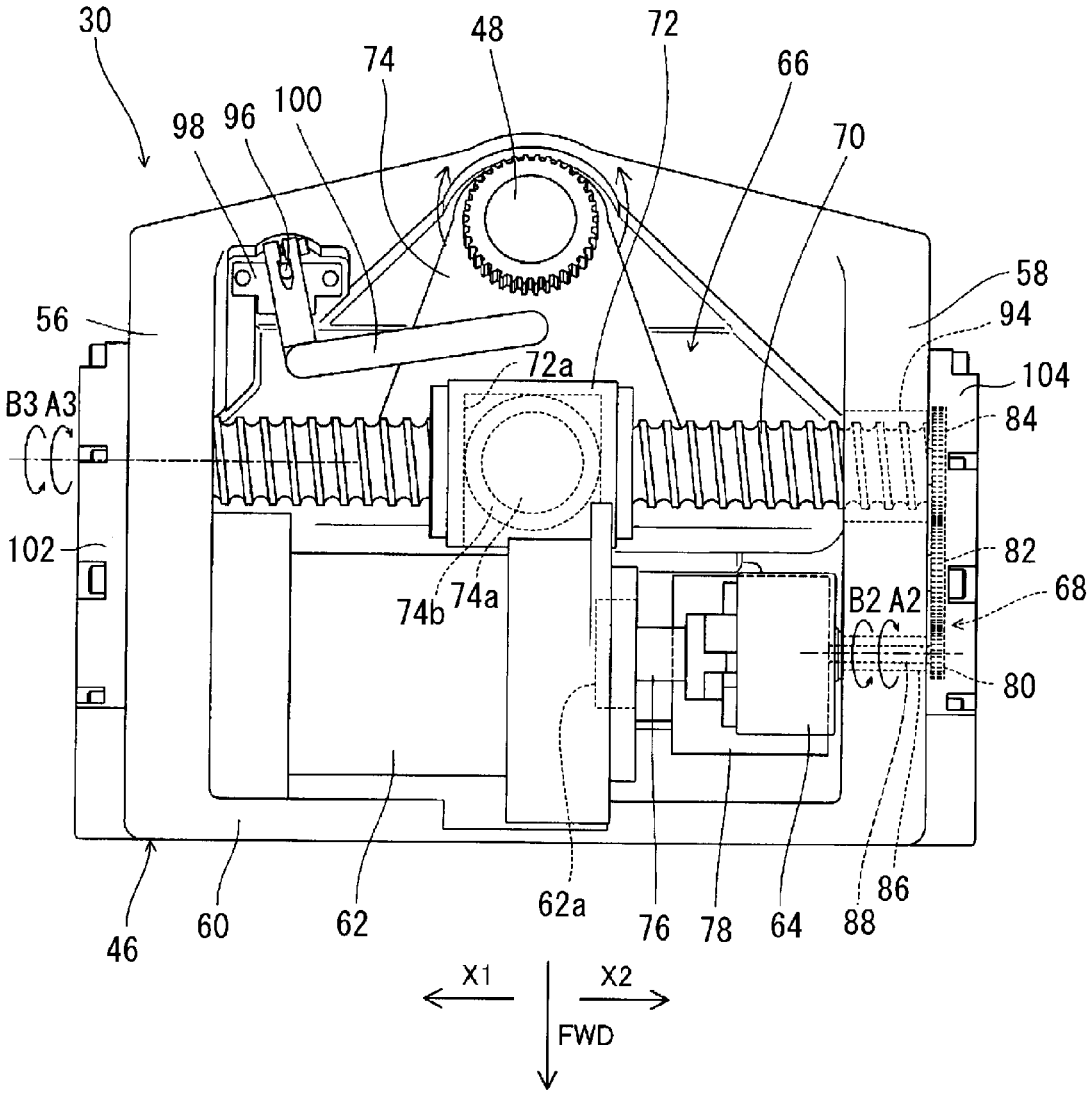
FIG. 6 is a plan view for describing the configuration of the swivel bracket of the outboard engine in FIG. 1.

Next, reference will also be made to FIG. 4 through FIG. 6 to describe the swivel bracket 30 in detail.

The bracket upper portion 46 is at an upper end of the bracket lower portion 44, protruding in the forward direction (Direction indicated by Arrow FWD). The bracket upper portion 46 preferably has a substantially upward opening box configuration, and includes a pair of two side wall portions 56, 58 each having an increasing height toward the front as viewed from a side; and a front wall portion 60 which connects these two side wall portions 56, 58 at their front ends. The upper end 50 of the swivel shaft 48 which is inserted into the bracket lower portion 44 protrudes in the bracket upper portion 46.

The bracket upper portion 46 houses an electric motor 62, a locking clutch 64 and most of a transmission mechanism 66.

The transmission mechanism 66, which transmits the driving force of the electric motor 62 to the outboard engine main body 28, includes a gear section 68; a ball screw 70 connected with the gear section 68; a ball nut 72 engaged with the ball screw 70 movably on the ball screw 70; a transmission plate 74 which connects the ball nut 72 with the swivel shaft 48; the swivel shaft 48; and the connection fitting 52. The transmission mechanism 66 is designed to rotate the swivel shaft 48 by approximately 1° through 1.5°, for example, for each rotation of the motor shaft 76 of the electric motor 62. In other words, the transmission mechanism 66 has a transmission ratio (reduction ratio of this preferred embodiment) of 270 through 360, for example.

The electric motor 62 is provided inside the swivel bracket 30, near the front wall portion 60 closer to the side wall portion 56, with its motor shaft 76 extending in the widthwise direction of the hull 2 (indicated by Arrow X1 and Arrow X2). The electric motor 62 provides power to pivot the outboard engine main body 28. Also, the electric motor 62 preferably includes a pivot sensor 62*a* which detects a pivot angle of the motor shaft 76.

The electric motor 62 is electrically connected with a driver 78. When the user performs a steering operation in the steering section 12, the driver 78 receives operation signals via the LAN cable 26 and controls the operation of electric motor 62 based on the signals. Specifically, when the steering section 12 is being rotated in the clockwise direction (Arrow A1 direction: see FIG. 1), the driver 78 controls the electric motor 62 so that the motor shaft 76 will rotate in Arrow A2 direction. On the other hand, when the steering section 12 is being rotated in the counterclockwise direction (Arrow B1 direction: see FIG. 1), the driver 78 controls the electric motor 62 so that the motor shaft 76 will rotate in Arrow B2 direction.

The locking clutch 64 is disposed coaxially with the motor shaft 76 of the electric motor 62, connects the motor shaft 76 with the gear section 68 and transmits the driving force from the electric motor 62 toward the swivel shaft 48, i.e., toward the outboard engine main body 28. However, the locking clutch 64 also has a locking capability of not transmitting an external force (reaction force) from the outboard engine main body 28 to the electric motor 62 thereby preventing the outboard engine main body 28 from being pivoted in the right-left direction by the external force. The locking clutch 64 preferably is a reverse input shutoff clutch which is provided by, e.g., a product called "Torque Diode" (Registered Trademark) manufactured by NTN Corporation. Thus, as the motor shaft 76 rotates, rotation of the motor shaft 76 is transmitted to the locking clutch 64 and to the gear section 68 connected therewith. On the other hand, when the outboard engine main body 28 receives a pivoting force in the right-left direction during navigation, for example, and even if the gear section 68 receives a rotational force, the gear section 68 will not rotate since the locking clutch 64 will lock and prevent the gear section 68 from rotating. In other words, during navigation, even if reaction forces applied by the water or other forces act in the right-left direction with respect to the outboard engine main body 28, the locking clutch 64 works and there is no need to drive the electric motor 62 in order to maintain the pivot angle. The locking clutch 64 of such a simple configuration eliminates the need for keeping the electric motor 62 always in drive.

The gear section 68 serves as reduction gears and as shown in FIG. 5 and FIG. 6, preferably includes three flat gears 80, 82 and 84 which are provided outside the side wall portion 58, respectively. Each of the flat gears 80, 82 and 84 is preferably made of an elastic synthetic resin such as nylon and polyacetal, for example. The flat gear 80 is connected with a shaft member 88, which protrudes from a downstream side of the locking clutch 64 (toward the side wall portion 58) and penetrates through the through-hole 86 in the side wall portion 58, rotates with the shaft member 88. As shown in FIG. 5, the flat gear 82 is connected with a shaft member 90 provided rotatably in the side wall portion 58 via a buffer member 92, and rotates with the shaft member 90. The buffer member 92 is an annular (cylindrical) member inserted between an inner circumferential surface of the flat gear 82 and an outer circumferential surface of the shaft member 90, and is preferably made of an elastic material such as butyl rubber and nitrile rubber, for example. The flat gear 82 is engaged with the flat gear 80 and also with the flat gear 84. In other words, the flat gear 82 serves as a middle gear which transmits the rotation of the flat gear 80 to the flat gear 84. As shown in FIG. 6, the flat gear 84 is connected with a ball screw 70 penetrating the through-hole 94 in the side wall portion 58, and rotates integrally with the ball screw 70.

As the ball screw 70 rotates, the ball nut 72 moves axially of the ball screw 70 (in direction indicated by Arrow X1 and Arrow X2). Specifically, as the motor shaft 76 rotates in Arrow A2 direction, the gear section 68 rotates the ball screw 70 in Arrow A3 direction, and the ball nut 72 moves toward the side wall portion 58 (in Arrow X2 direction). On the other hand, as the motor shaft 76 rotates in Arrow B2 direction, the gear section 68 rotates the ball screw 70 in Arrow B3 direction, and the ball nut 72 moves toward the side wall portion 56 (in Arrow X1 direction).

Figure 7:
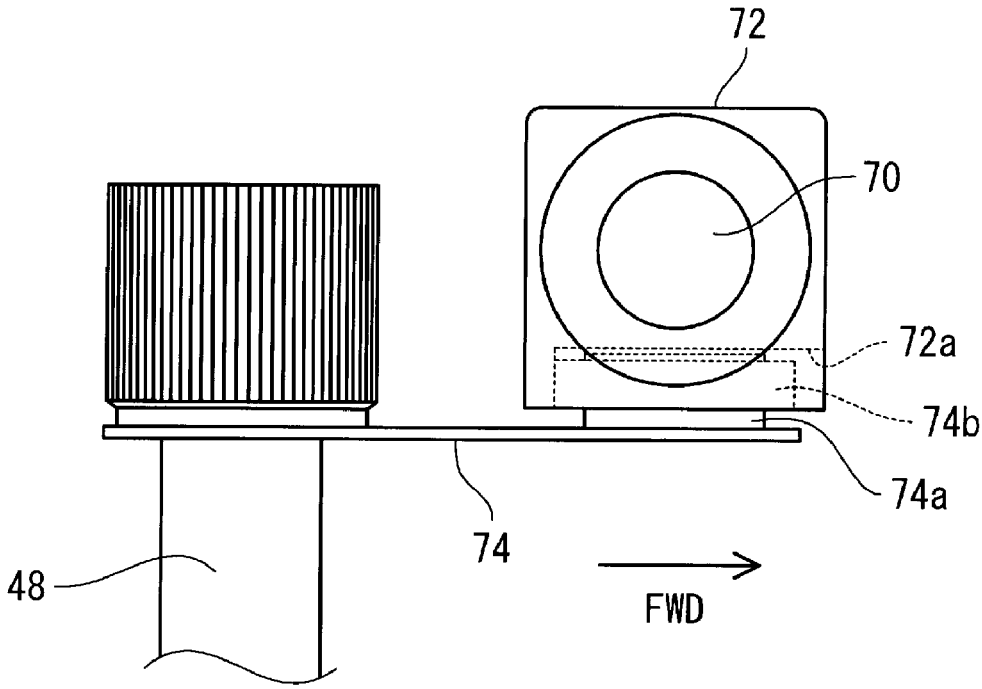
FIG. 7 is a side view for describing a connection relationship between a ball nut and a transmission plate in the outboard engine in FIG. 1.

As shown in FIG. 6 and FIG. 7, a cylindrical projection 74*a* is provided at a forward (Arrow FWD direction) end portion in an upper surface of the transmission plate 74. The projection 74*a* has an outer circumferential surface provided with an annular (cylindrical) buffer member 74*b*. The buffer member 74*b* is preferably made of an elastic material such as butyl rubber and nitrile rubber, for example. The ball nut 72 and the transmission plate 74 are connected with each other by fitting the buffer member 74*b* into a groove 72*a* provided in a lower end portion of the ball nut 72. The elastic buffer member 74*b* serves as a bushing at a place of connection between the ball nut 72 and the transmission plate 74.

As shown in FIG. 6, transmission plate 74 has a rearward end portion engaged with the swivel shaft 48. Thus, the transmission plate 74 can pivot around the swivel shaft 48 as the ball nut 72 moves in Arrow X1 direction or Arrow X2 direction, allowing the swivel shaft 48 to rotate to pivot the outboard engine main body 28. As the ball nut 72 moves toward the side wall portion 58 (in Arrow X2 direction), the outboard engine main body 28 is steered in Arrow X1 direction while it is steered in Arrow X2 direction as the ball nut 72 moves toward the side wall portion 56 (in Arrow X1 direction).

Near the transmission plate 74 and closely to the side wall portion 56, a pivot sensor 98 is provided to detect a pivoting angle of its pivot shaft 96. The pivot sensor 98 is connected with the transmission plate 74 via a link member 100. The link member 100 is moved by a pivotal movement of the transmission plate 74 around the swivel shaft 48, and as the link member 100 moves, the pivot shaft 96 of the pivot sensor 98 pivots. The pivot sensor 98 detects the pivoting angle of the pivot shaft 96, based on which the ECU 16 calculates a pivoting angle of the transmission plate 74, i.e., an actual pivot angle of the outboard engine main body 28.

With the above described arrangement, a cover member 102 is attached to the side wall portion 56 of the bracket upper portion 46 whereas a cover member 104 is attached to the side wall portion 58 to cover the gear section 68 and the through-holes 86, 94. Also, a cover member 106 is attached as shown in FIG. 5, on the upper surface of the bracket upper portion 46 so as to cover the entire upper opening, thereby sealing the inside space of the bracket upper portion 46.

Returning to FIG. 2, in the boat propelling system 10 as described so far, the ECU 16 includes a CPU and a memory. The memory stores programs, various threshold values, various flags and others for performing an operation shown in FIG. 8.

The ECU 16 receives a signal which indicates the steering angle of the steering section 12, from the steering angle sensor 18; a control signal from the control lever section 14; signals which indicate the pivot angle, from the pivot sensors 62*a*, 98.

The ECU 16 calculates a target torque in accordance with a given steering angle and a state of external force detected by an unillustrated external force sensor, and gives the calculated target torque to the reaction force motor 20. The reaction force motor 20 outputs a reaction force torque in accordance with the given target torque to the steering section 12. This provides various operation feelings from heavy to light during operation of the steering section 12.

Also, the ECU 16 sends a signal, which indicates a target pivot angle given by the user as he/she rotates the steering section 12, to the driver 78 inside the swivel bracket 30. The ECU 16 thereby controls steering of the outboard engine main body 28. Further, the ECU 16 sends a signal which represents the user's operation of the control lever section 14 to the ECU 42 inside the outboard engine main body 28, thereby controlling the output of the engine 40. The propeller 38 rotates as the engine 40 drives.

Further, the ECU 16 gives commands to the notification section 24 thereby controlling the notification section 24. The notification section 24 preferably includes, for example, a buzzer which gives off a sound; a lamp which gives off a light; and a liquid crystal display which displays messages, for example.

In the present preferred embodiment, the outboard engine main body 28 represents the propelling system main body whereas the locking clutch 64 represents the locking member. The bracket section includes the swivel bracket 30 and the tilt bracket 32; the actual pivot angle detection section includes the pivot sensor 98 and the ECU 16; the first information obtaining section includes the ECU 16; and the second information obtaining section includes the pivot sensor 62*a* and the ECU 16. Also, the ECU 16 functions as the determination section and the control section. Further, the elastic flat gears 80, 82 and 84 also function as the buffer members.

Now, an operation example of the boat 1, which is equipped with the boat propelling system 10 as described above, will be described with reference to FIG. 8.

Figure 8:
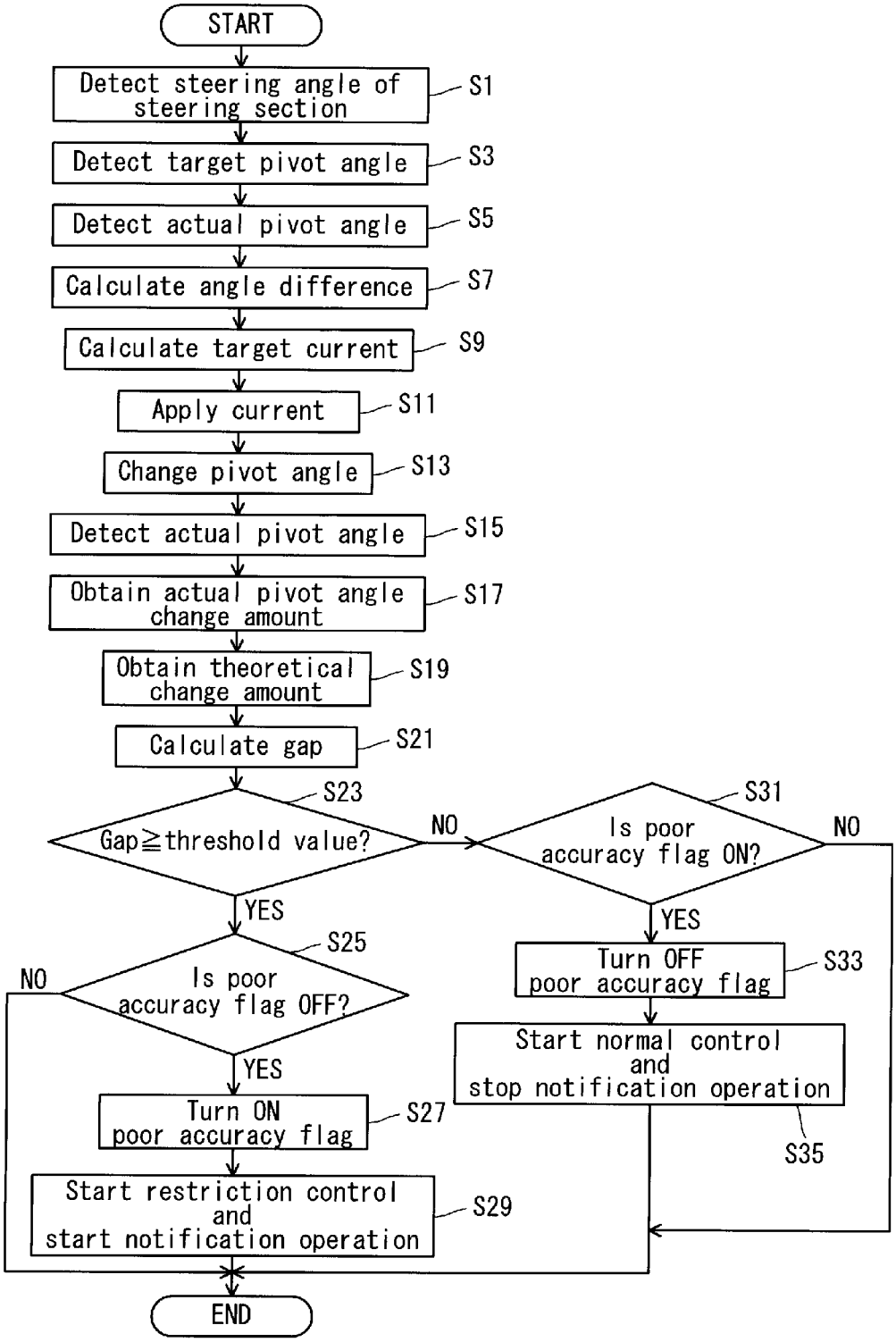
FIG. 8 is a flowchart showing an example of operation in a preferred embodiment of the present invention.

The operation shown in FIG. 8 is repeated in a time interval of about 5 milliseconds, for example. When the operation shown in FIG. 8 is performed for the first time, a poor accuracy flag, which is an indicator of decreased operation accuracy of the transmission mechanism 66, etc., is in an OFF state, and the system is in a normal control mode where an output control of the engine 40 is based on an amount of operation made to the control lever section 14.

First, the steering angle sensor 18 detects a steering angle in the steering section 12 (Step S1), and the ECU 16 calculates a target pivot angle based on the steering angle (Step S3). Then, the pivot sensor 98 detects a pivot angle of the pivot shaft 96, and based on the detected pivot angle, the ECU 16 detects an actual pivot angle of the outboard engine main body 28 (Step S5). Then, the ECU 16 calculates an angle difference between the calculated target pivot angle and the actual pivot angle of the outboard engine main body 28 (Step S7), and then calculates a target current based on the obtained angle difference (Step 9). Based on the target current calculated by the ECU 16, the driver 78 applies a current to the electric motor 62 (Step S11), whereupon the driving power from the electric motor 62 is transmitted via the transmission mechanism 66 to the outboard engine main body 28, to change the pivot angle of the outboard engine main body 28 (Step S13).

After Step S13, the ECU 16 detects an actual pivot angle of the outboard engine main body 28 again, based on a result of detection by the pivot sensor 98 (Step S15). Then, the ECU 16 calculates a difference between the actual pivot angle detected in Step S5 and the actual pivot angle detected in Step S15, thereby obtaining an actual pivot angle change amount in the outboard engine main body 28 (Step S17). In the present preferred embodiment, the actual pivot angle change amount obtained in Step S17 represents the first information.

After Step S17, the ECU 16 obtains an angle change amount of the motor shaft 76 (a drive amount of the electric motor 62) in Step S13 based on a signal from the pivot sensor 62*a*. In other words, the ECU 16 obtains an angle change amount of the motor shaft 76 during the time of pivot angle change, and then calculates a product of the angle change amount of the motor shaft 76 and the reduction ratio of the transmission mechanism 66 (for example, 270 in the present preferred embodiment). Theoretically, the pivot angle of the swivel shaft 48 and the pivot angle of the motor shaft 76 are in a proportional relationship based on the reduction ratio of the transmission mechanism 66. Hence, calculation of a product of the angle change amount of the motor shaft 76 and the reduction ratio of the transmission mechanism 66 gives a calculated theoretical pivot angle change amount (hereinafter called the calculated theoretical change amount) for cases where the transmission mechanism 66 is in normal condition (Step S19). In the present preferred embodiment, the calculated theoretical change amount obtained in Step S19 represents the second information.

After Step S19, the ECU 16 calculates an amount of gap between the calculated theoretical change amount and the actual pivot angle change amount (Step S21), and compares the resulting value with a predetermined threshold value (about 0.4°, for example) (Step S23), thereby determining the state of the locking clutch 64 and the transmission mechanism 66. In the present preferred embodiment, an amount of gap not smaller than the threshold value leads to a determination that a decrease in operation accuracy of the locking clutch 64 and the transmission mechanism 66 has exceeded a tolerable range whereas an amount of gap smaller than the threshold value leads to a determination that a decrease in operation accuracy of the locking clutch 64 and the transmission mechanism 66 is within the tolerable range. The threshold value is preferably selected from a range of about 0.3° through about 0.5°, for example. A threshold value within this range will give a tolerable range which is not too narrow (not too strict) nor too wide, ensuring acceptable operation accuracy of the locking clutch 64 and the transmission mechanism 66.

If the amount of gap in Step S23 is not smaller than the threshold value, i.e., if it is determined that operation accuracy of the locking clutch 64 and the transmission mechanism 66 has decreased beyond the tolerable range, the ECU 16 determines whether or not the poor accuracy flag stored in the memory is OFF (Step S25). If the poor accuracy flag is OFF, then the ECU 16 turns ON the poor accuracy flag (Step S27), starts a restriction control, causes the notification section 24 to start a notification operation (Step S29), and then brings the process to an end. By making the notification section 24 start the notification operation in Step S29, the system can notify the user of the deterioration of the locking clutch 64 and the transmission mechanism 66.

The restriction control is a restrictive control on the output (the number of revolutions in the present preferred embodiment) of the engine 40. Specifically, the number of revolutions in the engine 40 is maintained at, for example, about 20% of a maximum number (6000 rpm, for example) regardless of the amount of operation made to the control lever section 14. Another example of the restriction control is to reduce the number of revolutions of the engine 40 by 1000 rpm, for example. Still another example may be that the engine throttle is completely closed.

On the other hand, if Step S25 determines that the poor accuracy flag is already ON, it means that the restriction control, and the notification operation by the notification section 24, are being performed. Therefore, the process is brought to an end without taking further steps.

Also, if Step S23 determines that the amount of gap is smaller than the threshold value, i.e., if it is determined that the level of deterioration in the locking clutch 64 and the transmission mechanism 66 is within the tolerable range, the ECU 16 determines whether or not the poor accuracy flag is ON (Step S31). If the poor accuracy flag is ON, then the ECU 16 turns OFF the poor accuracy flag (Step S33); starts a normal control, and stops the notification operation which is being performed by the notification section 24 (Step S35), and then brings the process to an end.

The normal control is a control where the output control on the engine 40 is based on the amount of operation made to the control lever section 14. It is normally assumed that if Step S29 was executed in the previous operation, causing the notification section 24 to perform a notification operation, the user will inspect/repair the locking clutch 64 and the transmission mechanism 66. As a result, Step S23 determines that the amount of gap is smaller than the threshold value, leading the process to go to Steps S31 through S35.

On the other hand, if Step S31 determines that the poor accuracy flag is OFF, it means that the normal control has been performed since the previous operation and the notification section 24 is not performing the notification operation. Therefore, the process is brought to an end without any further steps.

According to the boat propelling system 10 as described, operation accuracy of the transmission mechanism 66 can be determined easily by first obtaining an amount of gap between an actual pivot angle change amount based on a detection result from the pivot sensor 98 and the calculated theoretical change amount based on a drive amount of the electric motor 62, and then comparing the obtained value to a threshold value.

Also, the locking clutch 64 locks the transmission mechanism 66 when the outboard engine main body 28 receives an external force, whereby the outboard engine main body 28 is prevented from being pivoted in the right-left direction. This eliminates the need for supplying electric power constantly to the electric motor 62, making it possible to reduce electric power consumption. Since the locking clutch 64 as described is provided more on the transmission mechanism 66 side than is the electric motor 62, a decrease in operation accuracy of the locking clutch 64 caused by deterioration from wear, etc. will also increase the amount of gap between the actual pivot angle change amount and the calculated theoretical change amount. Hence, operation accuracy of the locking clutch 64 and the transmission mechanism 66 can be determined easily by comparing the amount of gap between an actual pivot angle change amount and a calculated theoretical change amount to a threshold value.

As the outboard engine main body 28 is subjected to external forces, impacts are applied to the transmission mechanism 66 but are absorbed by the buffer members 74*b* and 92. Also, the elastic gears 80, 82 and 84 function as buffer members, contributing in absorbing impacts applied to the transmission mechanism 66. These arrangements reduce deterioration of the locking clutch 64 and the transmission mechanism 66 caused by wear, etc., thereby reducing decreases in operation accuracy of the locking clutch 64 and the transmission mechanism 66. In other words, the present invention is capable of extending the life of the locking clutch 64 and the transmission mechanism 66.

Figure 9A:
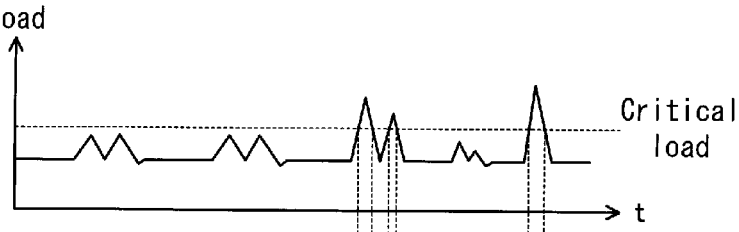
FIG. 9A through FIG. 9D are graphs for describing an advantage of buffer members.
Figure 9B:
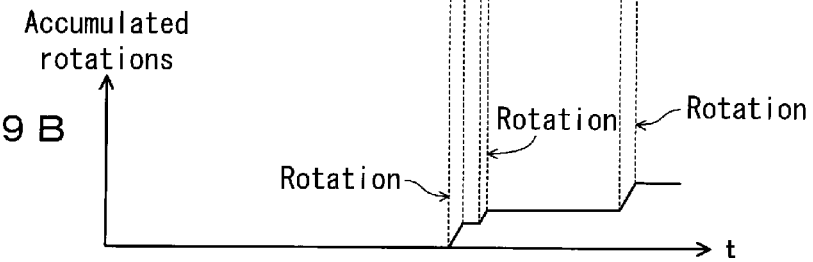

If there are no buffer members 74*b* and 92, and if the flat gears 80, 82 and 84 have no elasticity, i.e., if there is no damper mechanism provided, external forces applied to the outboard engine main body 28 act directly on the locking clutch 64 via the transmission mechanism 66. FIG. 9A shows an example of such a situation, indicating how load will change on the locking clutch 64 over time if there is no damper mechanism provided, and correspondingly, FIG. 9B shows accumulated rotations of the shaft member 88 (see FIG. 6).

As shown in FIG. 9A, if there is no damper mechanism provided, a load received by the locking clutch 64 exceeds a critical load of the locking clutch 64 more often. A load exceeding the critical load of the locking clutch 64 causes slippage in the locking clutch 64 and rotates the shaft member 88. More occasional slippage in the locking clutch 64 means more occasional rotations of the shaft member 88 as shown in FIG. 9B, resulting in increase in accumulated rotations of the shaft member 88. This can mean that the outboard engine main body 28 is pivoted by a large angle, and that adjustment of the orientation of the outboard engine main body 28 must be performed.

Figure 9C:
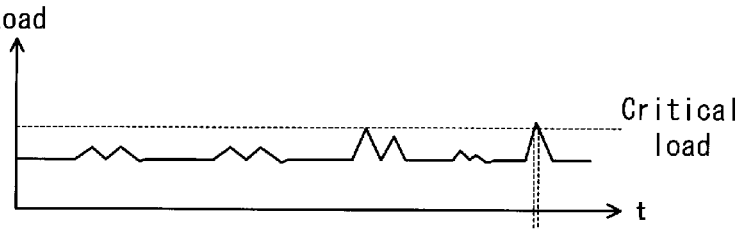
Figure 9D:
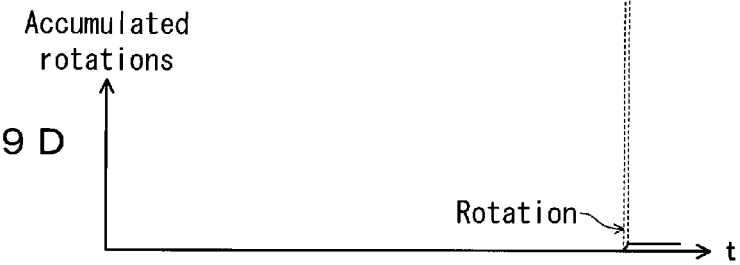

FIG. 9C shows an example of a case of the boat propelling system 10, indicating how load will change on the locking clutch 64. Correspondingly, FIG. 9D shows accumulated rotations of the shaft member 88. It should be noted here that in FIGS. 9A, 9B and FIGS. 9C, 9D, the outboard engine main body 28 receives external forces in the same amount and pattern.

According to the boat propelling system 10, it is possible to absorb a portion of external forces from the outboard engine main body 28 by the buffer members 74*b* and 92, and by the flat gears 80, 82 and 84. Hence, as shown in FIG. 9C, when an external force is exerted on the outboard engine main body 28, a load exerted on the locking clutch 64 is smaller than the critical load in most of the cases. This reduces slippage in the locking clutch 64 and rotation of the shaft member 88 as shown in FIG. 9D, which means that preferred embodiments of the present invention are capable of reducing orientation change in the outboard engine main body 28, practically eliminating need for adjusting the orientation of the outboard engine main body 28.

When it is determined that the locking clutch 64 and the transmission mechanism 66 have decreased operation accuracy, the output of the outboard engine main body 28 is restricted to reduce the boat speed. This prevents the hull 2 from deviating excessively from an intended direction of travel even under a situation where the locking clutch 64 and the transmission mechanism 66 have decreased operation accuracy and there is an increased gap between the target pivot angle and the actual pivot angle. In general, when the outboard engine main body 28 has a greater output and the boat speed is higher, the boat has a greater yaw rate. In other words, when the outboard engine main body 28 has a greater output and the boat speed is higher, the boat turns well even if the pivot angle is small. Preferred embodiments of the present invention therefore provide an advantage particularly when the outboard engine main body 28 has a high output.

It should be noted here that in the preferred embodiments described above, description was made for a case where the first information was preferably provided by the actual pivot angle change amount itself. However, the first information is not limited to this. The first information may be provided by an angle change amount of the pivot shaft 96 in the pivot sensor 98, an amount of travel of the ball nut 72, etc., for example.

Also, in the preferred embodiments described above, description was made for a case where the second information was preferably provided by a calculated theoretical pivot angle change amount itself. However, the second information is not limited to this. The second information may be provided by a calculated theoretical angle change amount of the pivot shaft 96 in the pivot sensor 98, a calculated theoretical amount of travel of the ball nut 72, etc., for example.

In the above preferred embodiments, description was made for a case where two of the outboard engines 22, for example, are preferably installed in the boat 1. However, the present invention is not limited by this. The present invention is applicable to cases where only one outboard engine is installed in a boat, or cases where three or more outboard engines are installed.

The present invention being thus far described in terms of preferred embodiments, it should be noted that the preferred embodiments may be varied in many ways within the scope and the spirit of the present invention. The scope of the present invention is only limited by the accompanied claims.

What is claimed is:

1. A boat propelling system for propelling a hull, the boat propelling system comprising:

a propelling system main body;

a bracket section arranged to allow the propelling system main body to pivot in a right-left direction with respect to the hull;

an electric motor provided in the bracket section to pivot the propelling system main body in the right-left direction;

a transmission mechanism provided in the bracket section to transmit a driving force of the electric motor to the propelling system main body;

an actual pivot angle detection section arranged to detect an actual pivot angle of the propelling system main body;

a first information obtaining section arranged to obtain first information regarding an actual pivot angle change amount of the propelling system main body based on a detection result of the actual pivot angle detection section;

a second information obtaining section arranged to obtain second information regarding a calculated theoretical pivot angle change amount of the propelling system main body based on a drive amount of the electric motor; and a determination section arranged to determine that an operation accuracy of the transmission mechanism is not within a tolerable range if a gap amount between the first information and the second information is greater than or equal to a threshold value, and to determine that the operation accuracy of the transmission mechanism is within the tolerable range if the gap amount between the first information and the second information is less than the threshold value.

2. The boat propelling system according to claim 1, further comprising a locking member provided more on the transmission mechanism side than is the electric motor, and arranged to lock the transmission mechanism to prevent the propelling system main body from being pivoted in the right-left direction by a force exerted on the propelling system main body.

3. The boat propelling system according to claim 1, wherein the transmission mechanism includes a buffer member arranged to absorb an impact.

4. The boat propelling system according to claim 1, further comprising a control section arranged and programmed to control an output of the propelling system main body based on a result of determination by the determination section.

5. The boat propelling system according to claim 1, further comprising a sensor arranged at an output shaft of the electric motor to detect a pivot angle of the output shaft of the electric motor.

6. The boat propelling system according to claim 1, wherein the drive amount of the electric motor is an angle change amount of an output shaft of the electric motor.

7. The boat propelling system according to claim 1, further comprising a restriction control section arranged to restrict an output of an engine of the propelling system main body when the operation accuracy of the transmission mechanism is not within the tolerable range.

8. The boat propelling system according to claim 7, wherein the restriction control section restricts a number of revolutions per minute of the engine of the propelling system main body.

* * * * *